US005690383A

United States Patent [19]

Meeker

[11] Patent Number: 5,690,383

[45] Date of Patent: Nov. 25, 1997

[54] BABY BUNGEE JUMPER

[75] Inventor: Paul K. Meeker, Hiram, Ohio

[73] Assignee: Lisco Inc., Tampa, Fla.

[21] Appl. No.: 612,474

[22] Filed: Mar. 7, 1996

[51] Int. Cl.[6] ..... A47D 1/00

[52] U.S. Cl. ..... 297/274; 472/105; 482/69; 297/344.12

[58] Field of Search ..... 297/5, 273, 274, 297/275, 338, 344.12, 344.18; 472/95, 103, 104, 105; 482/66, 68, 69

[56] References Cited

U.S. PATENT DOCUMENTS

| | | | |
|---|---|---|---|
| 16,942 | 3/1857 | Wellman . | |
| 517,403 | 3/1894 | Bradish et al. . | |
| 1,256,548 | 2/1918 | Gannon . | |
| 1,326,921 | 1/1920 | Dzimitowicz . | |
| 1,950,042 | 3/1934 | Upper | 297/274 X |
| 1,965,236 | 7/1934 | Hall | 297/274 X |
| 2,622,878 | 12/1952 | Mooney | 472/105 |
| 3,495,794 | 2/1970 | Polk, Jr. | 472/105 X |
| 5,328,410 | 7/1994 | Amburgey et al. | 472/103 X |
| 5,451,093 | 9/1995 | Petrie et al. | 482/66 X |

*Primary Examiner*—Peter R. Brown
*Attorney, Agent, or Firm*—Donald R. Bahr; Lawrence E. Laubscher, Jr.; Lawrence E. Laubscher, Sr.

[57] ABSTRACT

An improved baby bungee jumper is characterized by the use of bungee cords to elastically suspend an infant seat above a base resting on a floor and by an adjustment mechanism for vertically adjusting the seat relative to the floor to accommodate infants of different size. The base includes a plurality of vertically extending legs and the bungee cords are connected between the seat and the upper ends of the legs. The adjustment mechanism is provided on the legs where the bungee cords are connected.

10 Claims, 4 Drawing Sheets

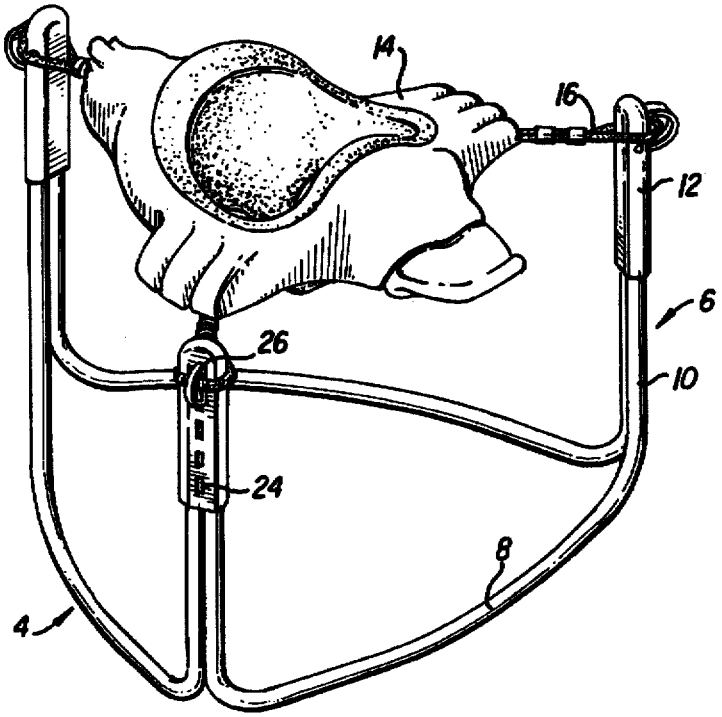
FIG. 3
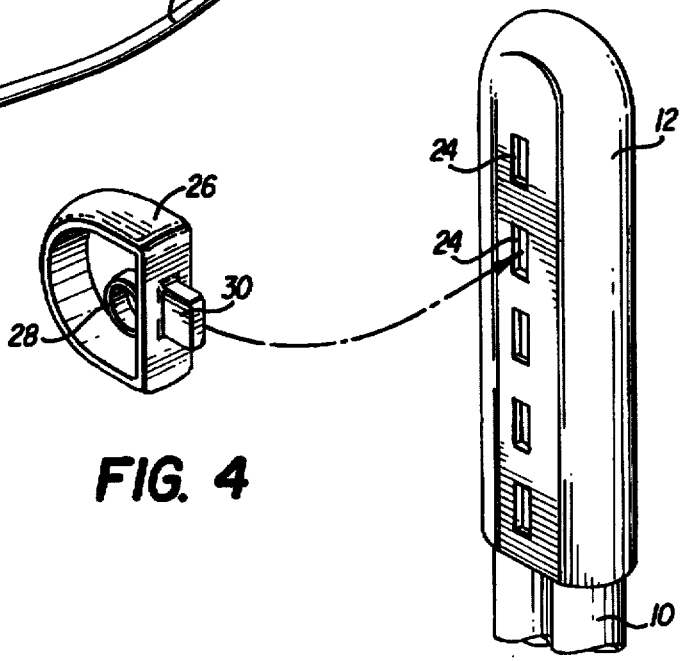
FIG. 4
FIG. 5a
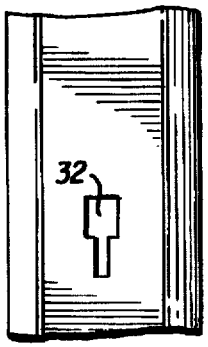
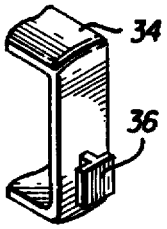
FIG. 5b
FIG. 6a
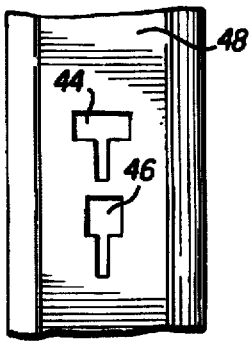
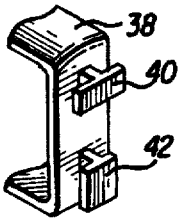
FIG. 6b

BABY BUNGEE JUMPER

BACKGROUND OF THE INVENTION

Even before a baby can walk, it has a desire and a need for movement and exercise. This desire manifests itself in crawling and other types of movement which require that the baby be attended or under surveillance to insure that the baby does not harm or endanger itself.

The present invention relates to an improved infant seat which allows an infant or young child to be safely and securely retained in the seat while also allowing the infant to play and exercise by jumping off of the floor on which the seat is arranged. The infant can be safely left unattended in the infant seat since the seat remains stationary where it is positioned on the floor, even as the infant jumps up and down in the seat.

BRIEF DESCRIPTION OF THE PRIOR ART

Infant jumping seats which afford bouncing movement of the seat relative to a frame are well-known in the patented prior art as evidenced by the U.S. Pat. to Wellman No. 16,942, Bradish et al No. 517,403, Gannon No. 1,256,548, Dzimitowicz No. 1,326,921, and Upper No. 1,950,042. In these devices, coil springs are used to support the seat relative to the frame. These prior devices were heavy and cumbersome and in some instances did not adequately support an infant.

An improved infant seat is disclosed in the U.S. Pat. to Petrie et al No. 5,451,093 which relates to an infant seat and table resiliently mounted on a four-legged base so that the seat and table can bounce with respect to the base. Endless rubber bands are used to connect the seat with the base to provide the resiliency necessary for the infant to tilt or bounce in the seat without tipping over.

While the Petrie device is an improvement over the prior devices, it still presents certain drawbacks which limit its acceptability in the marketplace. One such drawback is that the device is not easily adaptable to infants of different size. Another drawback is that the device is difficult to assemble and expensive to manufacture.

The present invention was developed in order to overcome these and other drawbacks of the prior devices by providing an inexpensive, safe, durable infant jump seat which can be adjusted to accommodate infants of different size.

SUMMARY OF THE INVENTION

Accordingly, it is a primary object of the present invention to provide an infant jump seat including a base adapted for resting on a floor and having a plurality of spaced vertically extending legs. A seat is connected with the base by a plurality of bungee cords extending between the seat and the upper ends of the legs so that the seat is elastically suspended between the legs above the base. The seat has a pair of openings for receiving an infant's legs when an infant is arranged therein. An adjustable connection mechanism is provided on the upper ends of the legs for the bungee cords which enables the seat to be vertically adjustable relative to the base. Thus, the seat may be adjusted to a position where the infant's feet extend to the floor when the infant is placed in the seat enabling the infant to jump on the floor while being suspended in the seat.

According to another object of the invention, the legs of the base each include a sleeve mounted on the upper portion thereof, with the adjustable connection mechanism provided on the sleeve and the bungee cords being connected therewith. In one embodiment, the sleeve includes a plurality of vertically spaced hooks for retaining a cord in a selected vertical position on the leg. In another embodiment, the sleeve contains a plurality of vertically spaced slots and the bungee cords each include a fastener which can be inserted in a selected slot to vertically position the seat. The fastener preferably is keyed so that it can be locked into the selected slot which is configured to receive the keyed fastener.

It is yet another object to form the base from a plurality of U-shaped tubular members including a lower horizontal portion and a pair of vertically extending portions. The adjacent vertical portions of the tubular members are connected with the sleeve to form the legs of the base.

In an alternate embodiment of the invention, the legs of the base comprise upper and lower telescoping members. The lower leg member contains a plurality of vertically spaced openings and the upper leg member includes a displaceable pin adapted for engaging the openings. Thus, the upper leg member can be vertically adjusted relative to the lower leg member by arranging the pin in a selected one of the openings, thereby adjusting the seat relative to the floor. The base comprises a plurality of tubular members which are connected between either the upper leg members or the lower leg members to provide stability to the jump seat.

BRIEF DESCRIPTION OF THE FIGURES

Other objects and advantages of the invention will become apparent from a study of according to the ivention;

FIG. 3 is a perspective view of an alternate embodiment of the baby bungee jumper of the invention;

FIG. 4 is a detailed perspective view of the leg upper potion of the jumper of FIG. 3 and the fastener used to connect a bungee cord therewith;

Figure 1:
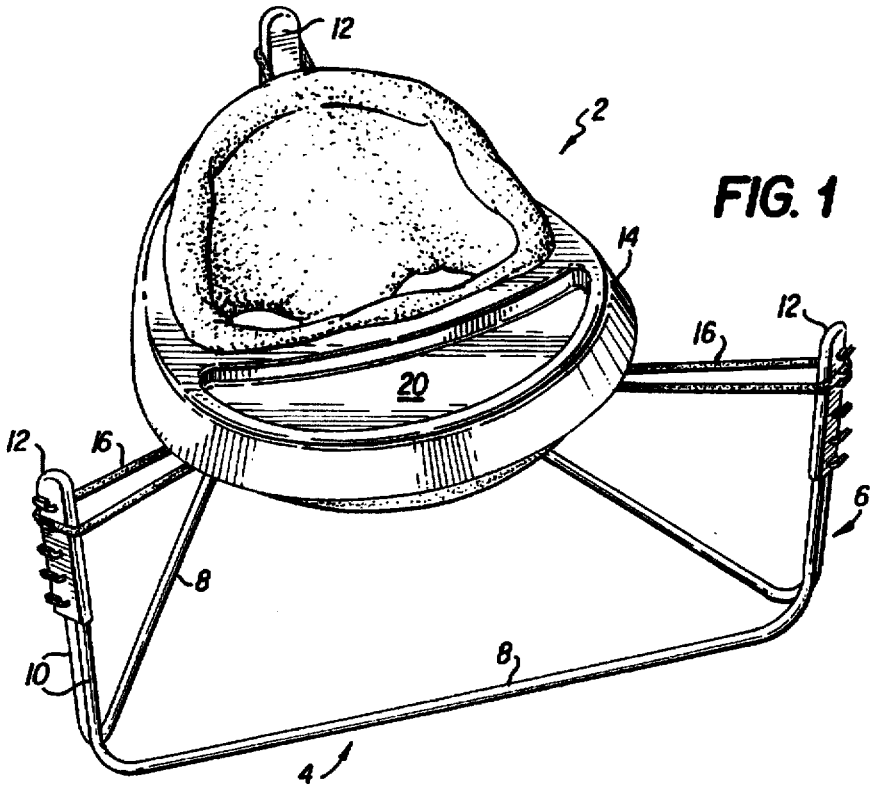
FIG. 1 is a perspective view of a preferred embodiment of the baby bungee jumper according to the invention.
Figure 9:
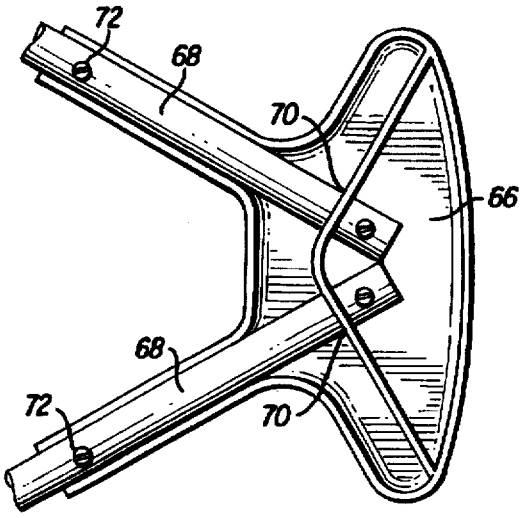
Figure 7:
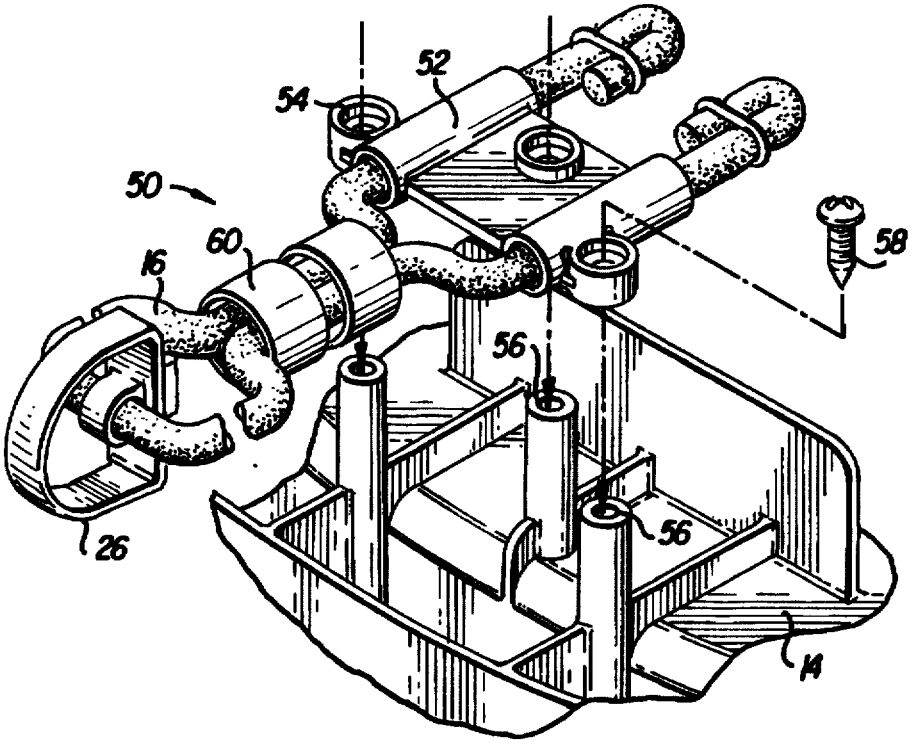
Figure 8:
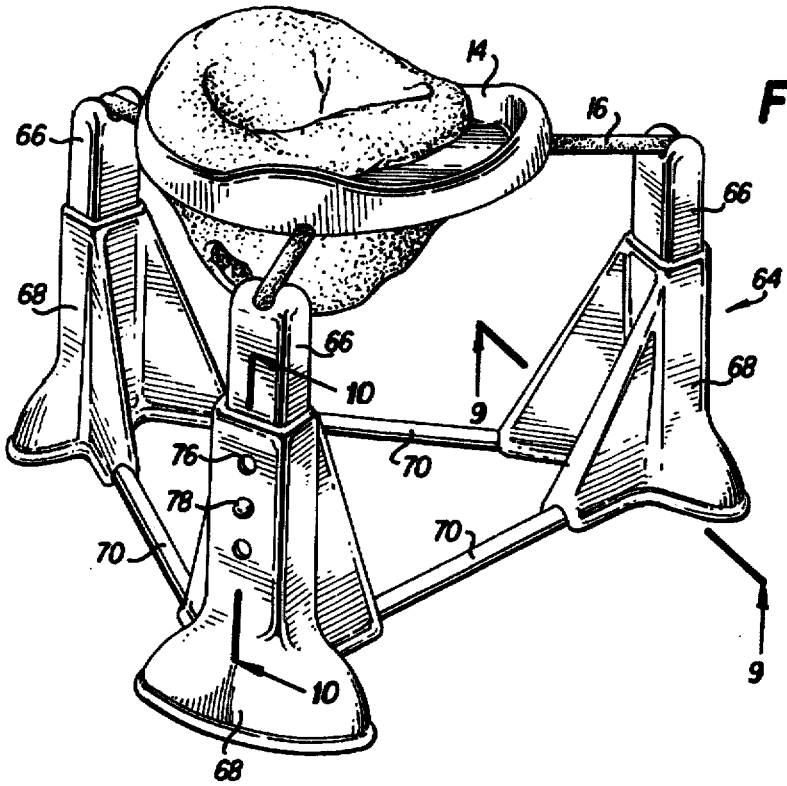
Figure 10:
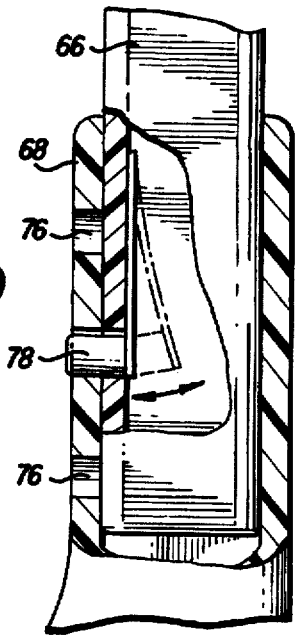
Figure 11:
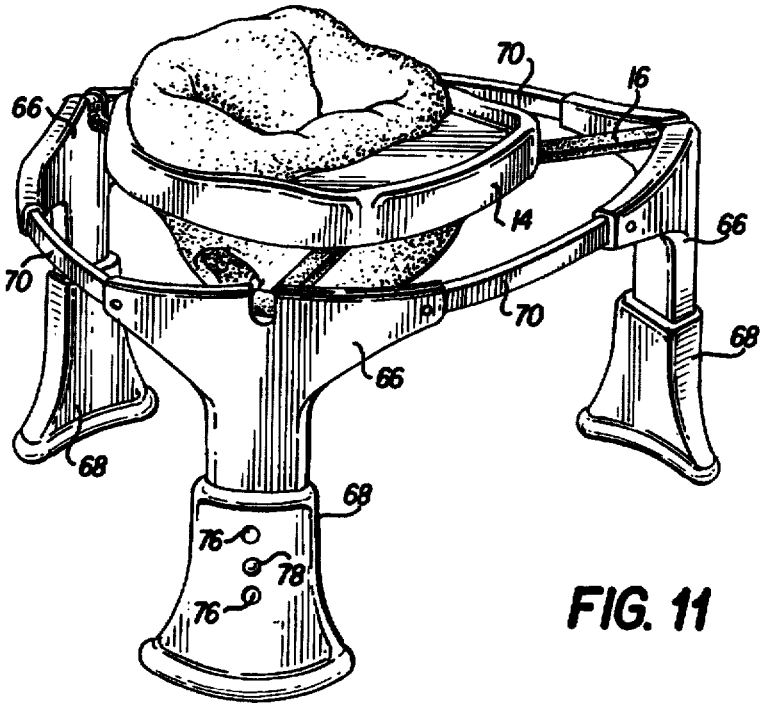

FIGS. *5a*, *5b*, *6a*, and *6b* are detailed illustrations of various locking assemblies for the fastener and leg potion of FIG. 4;

FIG. 7 is an exploded view of the clamping mechanism for connecting a bungee cord with the seat of the jumper of FIGS. 1 or 3;

FIG. 8 is a perspective view of a further embodiment of the baby bungee jumper according to the invention;

FIG. 9 and 10 are sectional views taken along lines 9—9 and 10—10, respectively, of FIG. 8; and FIG. 11 is a perspective view of an alternate embodiment of the jumper shown in FIG. 8.

DETAILED DESCRIPTION

Figure 2:
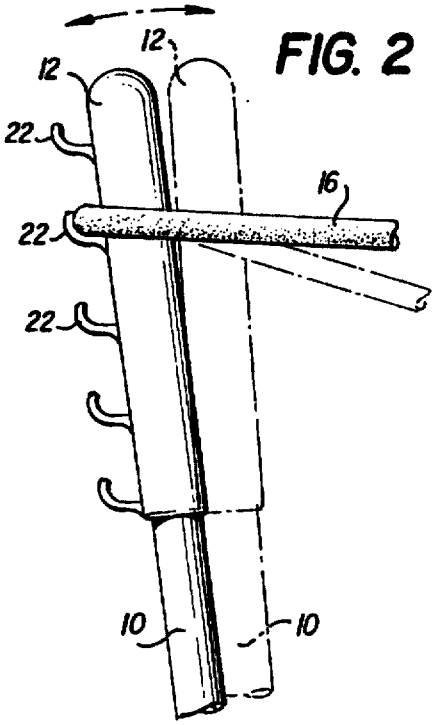
FIG. 2 is a side view of the leg upper portion of the jumper of FIG. 1 showing the adjustable connection of a bungee cord with the leg.

Referring first to FIGS. 1 and 2, the preferred embodiment of the baby bungee jumper 2 according to the invention will be described. The jumper includes a frame or base 4 having upwardly extending legs 6. More particularly, the base comprises a plurality of U-shaped tubular members having a lower horizontal portion 8 which is adapted for resting on a horizontal surface such as a floor and a pair of upwardly extending portions 10. The adjacent upwardly extending portions of the U-shaped members define the legs of the jumper and are connected by a sleeve 12 which fits over the upper ends of the portions 10. In FIG. 1, the base comprises three U-shaped members defining three legs, although it will be appreciated that a greater number of members defining a greater number of legs may be provided. The base tubular members are formed of any suitable durable material such as metal or synthetic plastic. As will be developed below, it is desirable that the material provide a slight degree of flexure between the legs 6 and the lower horizontal portions 8 of the members. The sleeve 12 can also be formed of metal or synthetic plastic.

A seat 14 is suspended from the upper ends of the legs 6 above the base by elastic cords 16 such as bungee cords. The seat is molded from a rigid material such as synthetic plastic and may include a cushion 18 for supporting an infant or baby and an integral tray 20 for supporting small toys, food, or the like. The seat further contains a pair of openings (not shown) for receiving the infant's legs when the infant is arranged in the seat.

The sleeves 12 which connect the upwardly extending portions 10 of the base members together include on an outer surface a plurality of vertically spaced hooks 22. As shown in FIG. 2 the hooks are configured to receive and retain the bungee cords 16 in a selected vertical position thereon. The bungee cords preferably have their ends securely connected with the underside of the seat 14 (as will be described with reference to FIG. 7 below) with the intermediate portion looped around the legs and retained in one of the hooks 22. By selecting which hook is to receive a cord 16, the seat 14 can be vertically adjusted relative to the floor to a position where the infant's feet extend to the floor. When properly adjusted, the seat can safely support the infant and allow the infant to jump on the floor without the jumper moving on the floor. The seat moves up and down with the infant owing to the elasticity of the cords 16. Additional vertical movement of the seat is achieved owing to the flexure of the legs 6 relative to the base 4 as shown in FIG. 2. As the infant and seat move downwardly, the sleeve 12 connecting the upper ends of the upwardly extending base portions 10 moves inwardly to the position shown by the broken lines.

The seat 14 of FIG. 3 is shown having a different configuration than that of FIG. 1. It will be appreciated that any seat configuration may be used in the baby bungee jumper according to the invention. For example, the seat may be configured as an animal as shown in FIG. 3. The seat may also be provided with a rotating mechanism (not shown) which allows the seat to rotate as well as bounce up and down with respect to the base.

FIG. 3 also illustrates an alternate embodiment for connecting the seat 14 with the upper ends of the legs 6. The sleeves 12 include a plurality of vertically spaced slots 24 which are adapted to receive a fastener 26 connected with the bungee cord 16. As shown in FIG. 4, the fastener 26 includes a receptacle 28 through which the cord passes and a projection 30 which is adapted for insertion in one of the slots 24. The slots are arranged on the outer surface of the sleeve as shown in FIG. 3. The fastener is thus lifted over the end of the sleeve for insertion into a selected one of the slots to vertically position the seat relative to the floor.

In the embodiment of FIG. 4, the projection 30 has a rectangular configuration and conforms to the configuration of the slots 24. The tension of the seat on the elastic cords serves to hold the fastener in the selected slot. In the embodiments of FIGS. 5 and 6, the fastener is adapted for locking in the selected slot. More particularly, in FIG. 5*a*, the slot 32 is shaped as a keyway and in FIG. 5*b*, the fastener 34 is shown having a keyed projection 36. In installation, the keyed projection is inserted laterally in the slot 32 and then displaced downwardly to secure or lock the fastener in the selected vertical slot on the sleeve. In the embodiment of FIG. 6, the fastener 38 has a pair of keyed projections 40, 42 (FIG. 6*b*) for insertion into a corresponding pair of slots 44, 46 (FIG. 6*a*) provided in the sleeve. A plurality of vertically spaced pairs of openings are provided in the sleeve 48 of FIG. 6*a* so that the fastener 38 of FIG. 6*b* can be arranged in the selected vertical position on the sleeve.

Turning now to FIG. 7, there is shown a clamping mechanism 50 for connecting the ends of the bungee cords 16 with the underside of the seat 14. The ends of the cord are passed through slots in a clamping plate 52. The plate includes a plurality of through-openings 54 aligned with threaded openings 56 in the seat. Screws 58 are used to fasten the plate with the seat via the openings. FIG. 7 also illustrates a spacer element 60 arranged over the bungee cord between the fastener 26 and the seat. At least one spacer element is provided on the cords to help restrain the cords and prevent an infant's hand or finger being pinched between the cords.

An alternate construction for the baby bungee jumper is shown in FIG. 8. The seat 14 and bungee cords 16 in this embodiment are similar to those described above in connection with FIGS. 1 and 3. In FIG. 8, the openings 62 in the seat for the infant's legs are shown. The primary difference lies in the base, legs, and adjustment mechanism. In FIG. 8, the legs 64 comprise telescoping upper 66 and lower 68 leg members. The lower leg members have an enlarged base for resting on the floor and are interconnected with tubular base members 70. More particularly, as shown in FIG. 9 the lower leg members contain interior openings 72 for receiving the ends of the base members 70. Screws 74 are used to secure the ends of the base members to the lower leg members.

The lower leg member 68 contains a plurality of vertically spaced openings 76 and the upper leg member 66 contains a displaceable pin 78 which is shown in FIG. 10 adapted to fit in the openings. When the pin is displaced inwardly, the upper leg member can be moved upwardly or downwardly with respect to the lower leg member. When the desired height is obtained, the pin can be released to engage the opening for that height to lock the upper leg member in position. Since the bungee cords are connected with the upper end of the upper leg members, the seat will thus be positioned at a desired height above the floor in accordance with the length of the baby's legs.

The baby bungee jumper shown in FIG. 11 is similar to that shown in FIG. 8, except that the tubular base members 70 are connected between the upper leg members 66. The height adjusting mechanism is the same as that shown in FIGS. 8 and 10. As in the jumpers shown in FIGS. 1 and 3, the jumpers in FIGS. 8 and 11 have legs, bases, and seats molded from any rigid material such as synthetic plastic. Unlike the jumpers in FIGS. 1 and 3, the legs 64 of the jumpers in FIGS. 8 and 11 do not flex relative to the base.

While in accordance with the provisions of the patent statutes the preferred forms and embodiments of the invention have been illustrated and described, it will be apparent to those of ordinary skill in the art that various changes and modifications may be made without deviating from the inventive concepts set forth above.

What is claimed is:

1. An infant jump seat, comprising (a) a base adapted for resting on a floor and including a plurality of spaced vertically extending legs, each leg having a sleeve mounted on the upper portion thereof;

(b) a seat containing a pair of openings for receiving an infant's legs when an infant is arranged therein;

(c) elastic means for connecting said seat with said sleeve of each of said legs, respectively, whereby said seat is elastically suspended between said legs above said base; and (d) adjusting means for vertically adjusting said seat relative to said base, said adjusting means being mounted on said sleeves, whereby said seat may be vertically adjusted to a position where the infant's feet extend to the floor when the infant is placed in said seat enabling the infant to jump on the floor while being suspended in said seat.

2. An infant jump seat as defined in claim 1, wherein said elastic means comprises a plurality of bungee cords.

3. An infant jump seat as defined in claim 2, and further comprising clamping means for removably connecting said bungee cords with said seat.

4. An infant jump seat as defined in claim 1, wherein said adjusting means comprises a plurality of vertically spaced hooks integral with said sleeve, said hooks removably retaining said cord in a selected vertical position on said leg.

5. An infant jump seat as defined in claim 1, wherein said bungee cords include a fastener and said adjusting means comprises a plurality of vertically spaced slots arranged in said sleeve for removably receiving said fastener in a selected vertical position on said leg.

6. An infant jump seat as defined in claim 5 wherein said fastener includes locking means for retaining said fastener within selected slots.

7. An infant jump seat as defined in claim 1, wherein said base has a tubular configuration.

8. An infant jump seat as defined in claim 7, wherein said base comprises a plurality of generally U-shaped tubular members including a lower horizontal portion and a pair of upwardly extending portions, the adjacent upwardly extending portions of said tubular members being connected with said sleeve to define said legs.

9. An infant jump seat as defined in claim 8, wherein said legs flex laterally with respect to said lower horizontal portions of said base tubular members.

10. An infant jump seat as defined in claim 9, wherein said base includes three legs.

* * * * *